US008203489B2

(12) United States Patent
Li et al.

(10) Patent No.: US 8,203,489 B2
(45) Date of Patent: Jun. 19, 2012

(54) DUAL-BAND ANTENNA

(75) Inventors: Chia-Tien Li, Hsichih (TW); Li-Jean Yen, Hsichih (TW)

(73) Assignee: Wistron Neweb Corp., Taipei Hsien (TW)

( * ) Notice: Subject to any disclaimer, the term of this patent is extended or adjusted under 35 U.S.C. 154(b) by 344 days.

(21) Appl. No.: 12/579,041

(22) Filed: Oct. 14, 2009

(65) Prior Publication Data

US 2010/0271264 A1 Oct. 28, 2010

(30) Foreign Application Priority Data

Apr. 22, 2009 (TW) ..... 98206683 U

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

2004/0135729 A1* 7/2004 Talvitie et al. ..... 343/702
2005/0264455 A1* 12/2005 Talvitie et al. ..... 343/702
2007/0139270 A1* 6/2007 Takei et al. ..... 343/700 MS
2009/0289859 A1* 11/2009 Pan ..... 343/702

FOREIGN PATENT DOCUMENTS

EP 1950833 A1 * 7/2008

* cited by examiner

*Primary Examiner* — Dieu H Duong
(74) *Attorney, Agent, or Firm* — Merchant & Gould P.C.

(57) ABSTRACT

A dual-band antenna includes a ground plane, a loop antenna, and a monopole antenna. The loop antenna is connected to the ground plane, and has a radiator that forms a loop. The radiator has a first end and a second end adjacent to the first end, and is capable of resonating at a first frequency band. The monopole antenna has one end connected to the first end of the radiator of the loop antenna, and is capable of resonating at a second frequency band. A feed point is disposed at a connection between the first end of the radiator of the loop antenna and the monopole antenna. A ground point is disposed at the radiator of the loop antenna proximate to the second end of the radiator.

6 Claims, 5 Drawing Sheets

DUAL-BAND ANTENNA

CROSS-REFERENCE TO RELATED APPLICATION

This application claims priority of Taiwanese Application No. 098206683, filed on Apr. 22, 2009.

BACKGROUND OF THE INVENTION

1. Field of the Invention

The present invention relates to a dual-band antenna, more particularly to a miniature dual-band antenna for application to portable electronic devices.

2. Description of the Related Art

In recent years, due to the development of wireless communication and the growth of people's demand for mobile communication with each passing day, more and more information is transmitted via wireless networks, resulting in an increase in demand for wireless communication bandwidth. Meanwhile, the demand for compact and lightweight portable electronic devices capable of wireless communication has become one of the main considerations in designing the appearance of the modern electronic devices. As such, the design of an antenna disposed in a compact and lightweight electronic device has a trend toward miniaturization.

However, due to the characteristics of antennas, the reduction in antenna size usually compromises the antenna performance as a result of physical limitations. Therefore, designing a dual-band antenna structure that has sufficient operating bandwidth and that is small enough is the main point addressed in the present invention.

SUMMARY OF THE INVENTION

Therefore, an object of the present invention is to provide a small, dual-band antenna that has sufficient operating bandwidth.

According to a first aspect, the dual-band antenna of the present invention includes a ground plane, a loop antenna, and a monopole antenna.

The loop antenna is connected to the ground plane, and has a radiator that forms a loop. The radiator has a first end and a second end adjacent to the first end. The monopole antenna has one end connected to the first end of the radiator of the loop antenna. A feed point is disposed at a connection between the first end of the radiator of the loop antenna and said one end of the monopole antenna. A ground point is disposed at the radiator of the loop antenna proximate to the second end of the radiator.

The loop antenna is capable of resonating at a first frequency band, and the monopole antenna is capable of resonating at a second frequency band lower than the first frequency band.

Preferably, the monopole antenna is formed integrally with the loop antenna, extends outwardly from the first end of the loop antenna, and further extends at one side of the loop antenna. The ground plane and the monopole antenna are disposed at different sides of the loop antenna, respectively.

Preferably, for improving the impedance matching of the monopole antenna, the dual-band antenna further includes a plate body interconnecting the first end of the radiator of the loop antenna and said one end of the monopole antenna. The feed point is disposed at the plate body.

Preferably, for reducing the dimensions of the dual-band antenna, the dual-band antenna further includes a substrate that has a first surface, a second surface opposite to the first surface, and first and second conductive vias extending through the first and second surfaces and spaced apart from each other. The ground plane and the loop antenna are disposed at the first surface of the substrate. The monopole antenna includes a first radiator section and a second radiator section. The first radiator section is disposed at the first surface of the substrate, extends outwardly from the second conductive via, and is disposed at one side of the loop antenna. The second radiator section is disposed at the second surface of the substrate and extends from the first conductive via to the second conductive via. The first conductive via is connected electrically to the first end of the loop antenna.

According to a second aspect, the dual-band antenna of this invention includes a loop antenna connected to a ground plane, and a monopole antenna. The loop antenna has a radiator that forms a loop. The radiator has a first end and a second end, and defines a first slot that opens toward the first end. One end of the monopole antenna is connected to the first end of the radiator of the loop antenna. The monopole antenna and the loop antenna cooperate to form a second slot that opens in a direction away from the first end of the radiator. A feed point is disposed at a connection between the first end of the radiator of the loop antenna and said one end of the monopole antenna. A ground point is disposed at the loop antenna.

The radiator of the loop antenna includes a first linear segment, a second linear segment, and a connecting segment interconnecting the first and second linear segments and cooperating with the first and second linear segments to form the first slot.

Alternatively, the radiator of the loop antenna includes a first linear segment, a second linear segment, and a ground-connecting segment connected to the ground plane and the first linear segment. The first linear segment, the second linear segment, and the ground-connecting segment cooperate to form the first slot.

The monopole antenna includes a linear first radiator section and a linear second radiator section connected to the first radiator section. The first and second radiator sections cooperate with the second linear segment of the radiator of the loop antenna to form the second slot.

Preferably, the dual-band antenna further comprises a substrate having a first surface and a second surface opposite to the first surface. The first radiator section is disposed at the first surface, and the second radiator section is disposed at the second surface. The first and second ends of the radiator are adjacent to each other.

This invention combines a loop antenna capable of resonating at a high frequency band and a monopole antenna capable of resonating at a low frequency band to produce the effect of a dual-band antenna, thereby allowing the application of the dual-band antenna in electronic devices that require two communication frequency bands, such as notebook computers. Furthermore, the dual-band antenna utilizes the mirror effect of the ground plane to allow the lengths of the loop antenna and the monopole antenna to be shortened to a quarter of a wavelength at the resonant frequency, or even shorter, thus achieving miniaturization of the dual-band antenna.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
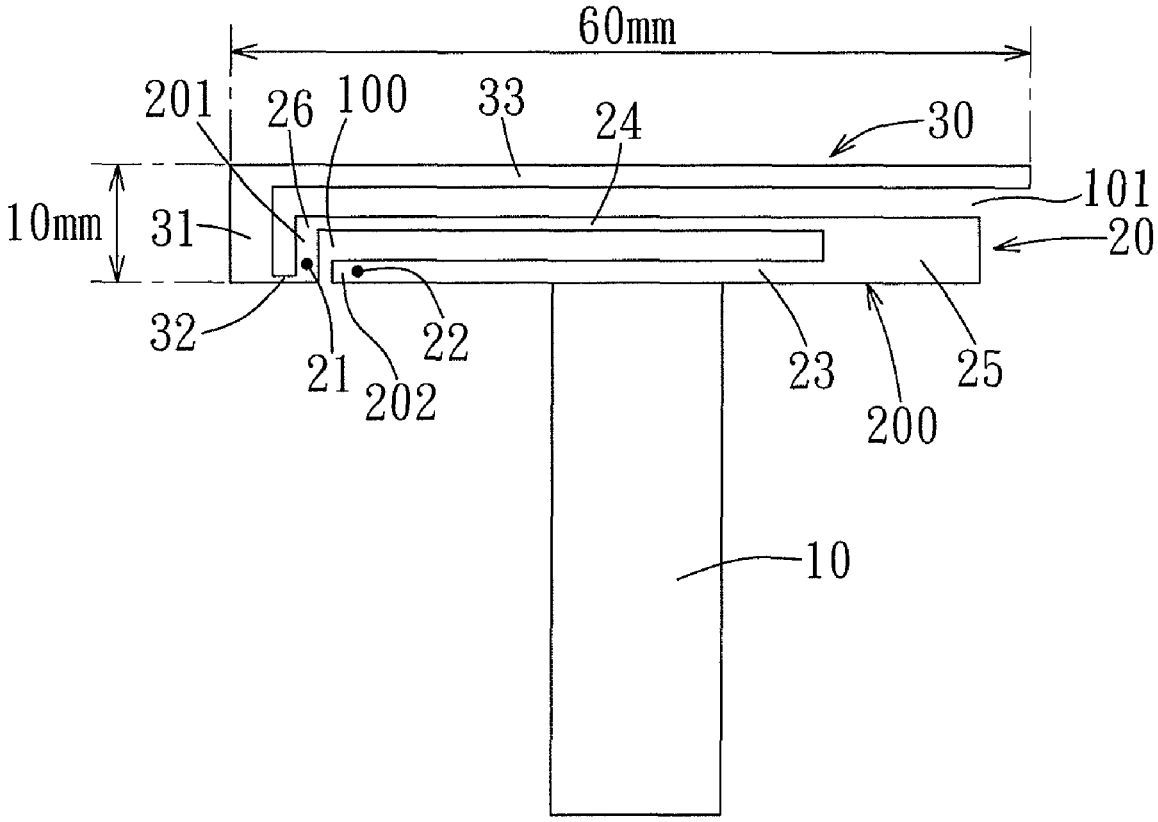
FIG. 1 is a schematic diagram to illustrate the first preferred embodiment of a dual-band antenna according to this invention.

Before the present invention is described in greater detail, it should be noted that like elements are denoted by the same reference numerals throughout the disclosure.

Referring to FIG. 1, the first preferred embodiment of a dual-band antenna according to this invention is shown to include a ground plane 10, a loop antenna 20, and a monopole antenna 30.

The ground plane 10 is a rectangular metal plate, such as a copper foil.

The loop antenna 20 is a quarter-wavelength rectangular loop antenna, is disposed at one side of the ground plane 10, and has a radiator 200 that forms a loop. The radiator 200 has a first end 201 and a second end 202 adjacent to the first end 201. The radiator 200 defines a first slot 100 that opens toward the first end 201.

The radiator 200 is a generally rectangular metal strip that includes: a first linear segment 23 that has the second end 202 and that is connected perpendicularly to the ground plane 10; a second linear segment 24 that is spaced apart from and parallel to the first linear segment 23; a rectangular connecting segment 25 that is distal from the second end 202 and disposed at a same side of the first linear segment 23 and the second linear segment 24, and that interconnects the first and second linear segments 23, 24; and a third linear segment 26 that extends from one end of the second linear segment 24 opposite to the connecting segment 25, that has the first end 201, and that is perpendicular to the second linear segment 24. Furthermore, the first linear segment 23, the second linear segment 24, and the connecting segment 25 cooperate to form the first slot 100.

In the present embodiment, a feed point 21 is disposed at a connection between the first end 201 of the radiator 200 of the loop antenna 20 and one end of the monopole antenna 30, and a ground point 22 is disposed at the first linear segment 23 and is proximate to the second end 202 of the radiator 200. The feed point 21 and the ground point 22 are connected electrically and respectively to a signal line and a ground line of a coaxial cable (not shown) for signal feeding purposes.

The loop antenna 20, through the mirror effect of the ground plane 10, can effectively miniaturize the antenna size to a quarter-wavelength of the operating frequency band. Thus, by appropriately adjusting the lengths of the first linear segment 23 and the second linear segment 24 of the radiator 200 of the loop antenna 20, the radiator 200 of the loop antenna 20 can resonate at a high frequency band, such as 2.4~2.5 GHz or 5.15~5.85 GHz, and the loop antenna 20 can hence serve as a WLAN signal transceiver antenna.

The monopole antenna 30 has one end connected to the first end 201 of the radiator 200 of the loop antenna 20, extends outwardly from the first end 201 of the radiator 200, and cooperates with the loop antenna 20 to form a second slot 101 that opens in a direction away from the first end 201 of the radiator 200.

The monopole antenna 30 includes: a linear first radiator section 31 that is longer than and that is parallel to and spaced apart from the third linear segment 26; a connecting section 32 that is connected to the first end 201 of the third linear segment 26 and one end of the first radiator section 31 and that has the feed point 21 disposed thereat; and a linear second radiator section 33 that extends from the other end of the first radiator section 31 and that is parallel to and spaced apart from the second linear segment 24 of the radiator 200 of the loop antenna 20. The first radiator section 31, the second radiator section 33, and the second linear segment 24 of the loop antenna 20 cooperate to form the second slot 101.

The monopole antenna 30, through the mirror effect of the ground plane 10, can miniaturize the antenna size to a quarter-wavelength of the operating frequency band, such that the overall length of the monopole antenna can be adjusted appropriately. In an exemplary implementation of the monopole antenna 30, when the length of the first radiator section 31 is 10 mm and the length of the second radiator section 33 is 60 mm, the monopole antenna 30 can resonate at a low frequency band.

On the other hand, the location at which the feed point 21 is disposed can be adjusted, according to impedance matching requirements, to any location at the connecting section 32 of the monopole antenna 30, e.g., proximate to the first end 201 of the third linear segment 26 of the loop antenna 20 or proximate to said one end of the first radiator section 31 of the monopole antenna 30.

Furthermore, since signals are fed to the monopole antenna 30 and the loop antenna 20 from the same feed point 21, an appropriate location of the feed point 21 can be selected to adjust the impedance matching, thus allowing the monopole antenna 30 and the loop antenna 20 to resonate at a quarter-wavelength of the signals being transmitted and received.

Figure 2:
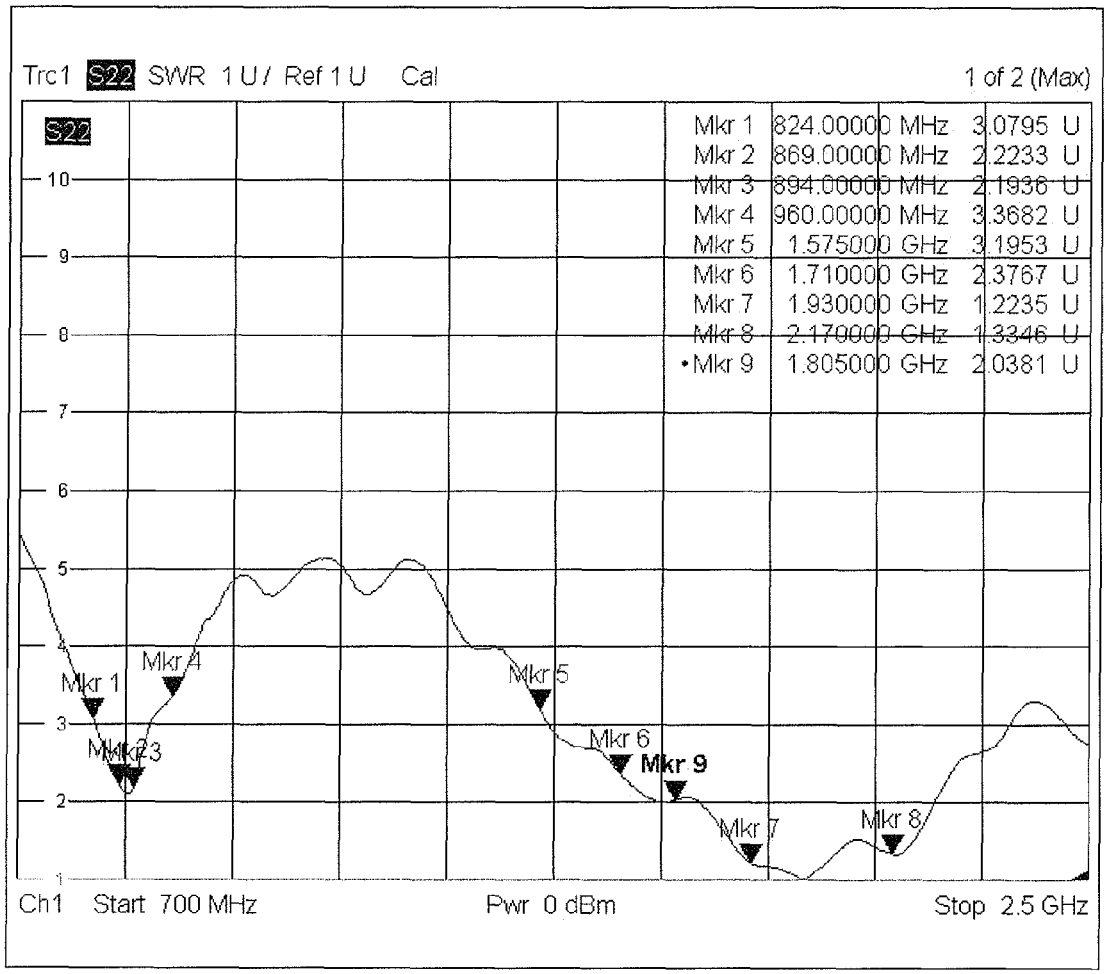
FIG. 2 is a VSWR plot obtained for the first preferred embodiment.

FIG. 2 illustrates a Voltage Standing Wave Ratio (VSWR) plot obtained for the dual-band antenna of this embodiment within the operating frequency band from 700 MHz to 2.5 GHz. The resonant bandwidth of the monopole antenna 30 is 11% ((Highest frequency-Lowest frequency)/Centre frequency, for VSWR of 3), and that of the loop antenna 20 is 40%.

Figure 3:
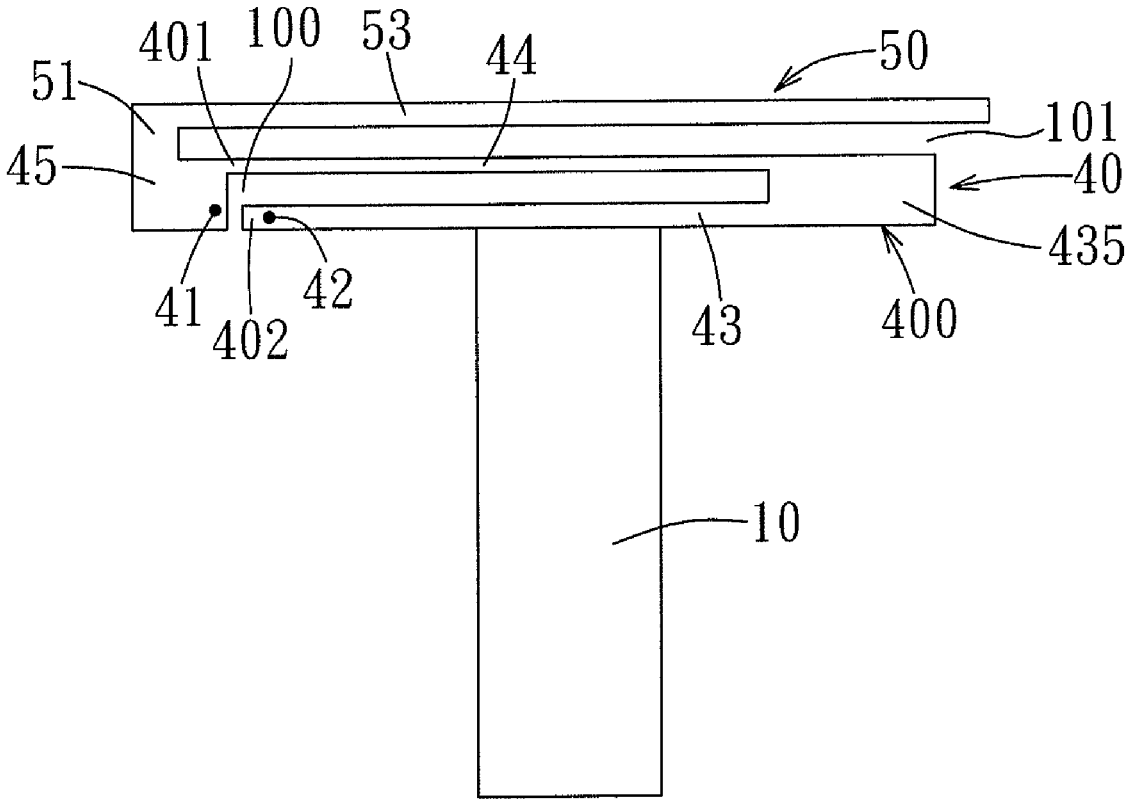
FIG. 3 is a schematic diagram to illustrate the second preferred embodiment of a dual-band antenna according to this invention.

FIG. 3 illustrates the second preferred embodiment of a dual-band antenna of this invention, which differs from the first preferred embodiment in that a plate body 45 replaces the third linear segment 26 of the radiator 200 of the loop antenna 20 of the first embodiment and the connecting section 32 of the monopole antenna 30 of the first embodiment, i.e., one end (namely, the first end 401) of the second linear segment 44 of the radiator 400 of the loop antenna 40 is directly connected to the plate body 45. One end of the first radiator section 51 of the monopole antenna 50 is directly connected to the second radiator section 53, while the other end thereof is directly connected to the plate body 45. The feed point 41 is disposed at an appropriate location on the plate body 45, while the ground point 42 is disposed proximate to one end of the first linear segment 43 (namely, the second end 402) of the radiator 400 of the loop antenna 40. The first linear segment 43, the second linear segment 44, and the connecting segment 435 of the radiator 400 cooperate to form the first slot 100. The first radiator section 51 and the second radiator section 53 of the monopole antenna 50 and the second linear segment 44 of the loop antenna 40 cooperate to form the second slot 101 that opens in a direction away from the first end 401 of the radiator 400 of the loop antenna 40. Moreover, the plate body 45 is capable of further improving the impedance matching of the monopole antenna 50, allowing an increase in the operating bandwidth of the monopole antenna 50.

Figure 4:
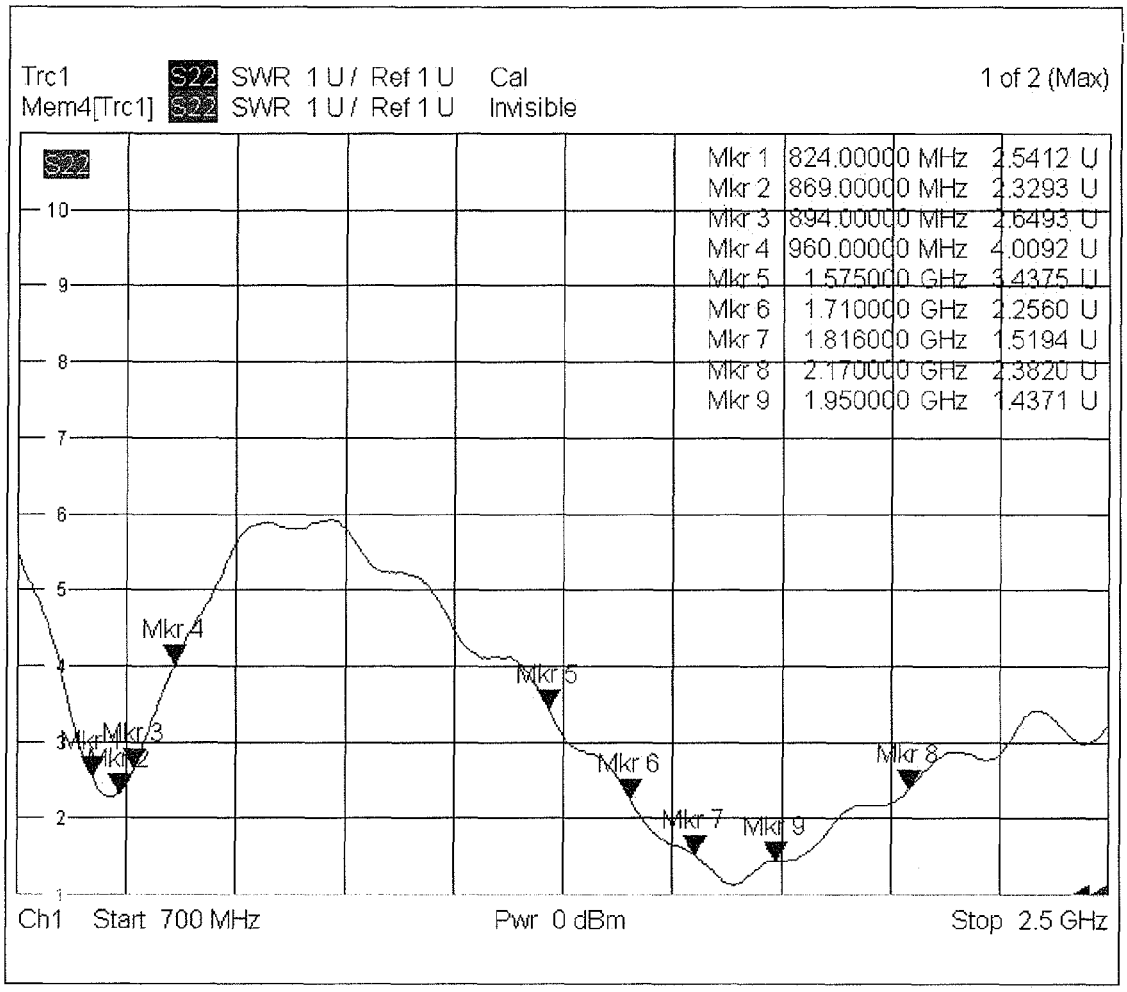
FIG. 4 is a VSWR plot obtained for the second preferred embodiment.

FIG. 4 illustrates a Voltage Standing Wave Ratio (VSWR) plot obtained for the dual-band antenna of this embodiment within the operating frequency band from 700 MHz to 2.5 GHz. The low frequency resonant bandwidth of the monopole antenna 30 is increased to 14%, while the high frequency resonant bandwidth of the loop antenna 20 is maintained at 40%.

Figure 5:
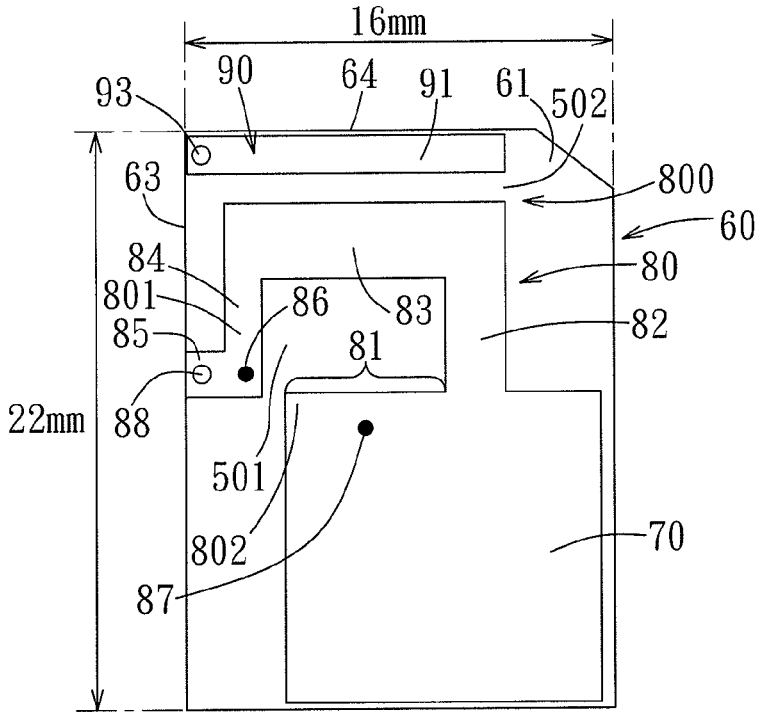
FIGS. 5 and 6 are schematic diagrams respectively showing first and second surfaces of a substrate of the third preferred embodiment of a dual-band antenna according to the present invention.
Figure 6:
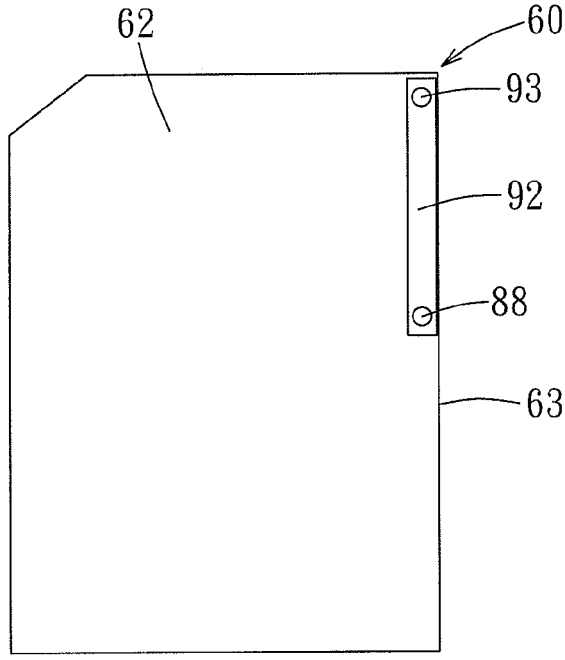

Referring to FIGS. 5 and 6, the third preferred embodiment of a dual-band antenna of this invention comprises a substrate 60, a ground plane 70, a loop antenna 80, and a monopole antenna 90.

The substrate 60 has a first surface 61 and a second surface 62 opposite to the first surface 61. The length and width of the substrate 60 are 22 mm and 16 mm, respectively. The ground plane 70 is disposed at the first surface 61 of the substrate 60 and has a rectangular shape.

The loop antenna 80 is connected to the ground plane 70 and has a radiator 800 that forms a loop. The radiator 800 has a first end 801 and a second end 802, and forms a first slot 501 that opens toward the first end 801.

The radiator 800 includes: a ground-connecting segment 81 connected to the ground plane 70; a first linear segment 82 extending from and perpendicular to the ground-connecting section 81; a second linear segment 83 connected to the first linear segment 82 and extending perpendicular to the first linear segment 82; and a third linear segment 84 connected to the second linear segment 83 and extending perpendicular to the second linear segment 83 and toward the ground plane 70. An extending segment 85 extends from one end of the third linear segment 84, i.e., the first end 801 of the radiator 800, to one edge 63 of the substrate 60. The ground-connecting segment 81, the first linear segment 82, and the second linear segment 83 cooperate to define the first slot 501.

The first end 801 of the radiator 800 is adjacent to one end of the ground-connecting segment 81 (namely, the second end 802 of the radiator 800). A feed point 86 is disposed at the extending segment 85, and a ground point 87 is disposed at the ground-connecting segment 81 of the radiator 800. The feed point 86 and the ground point 87 are connected electrically and respectively to a signal line and a ground line of a coaxial cable (not shown) for signal feeding purposes.

Furthermore, a first conductive via 88 is disposed at the extending section 85 and extends through the first and second surfaces 61, 62 of the substrate 60.

One end of the monopole antenna 90 is connected to the first end 801 of the radiator 800 of the loop antenna 80 via the extending segment 85. The monopole antenna 90 and the loop antenna 80 cooperate to form a second slot 502 that opens in a direction away from the first end 801 of the radiator 800.

The monopole antenna 90 includes a linear first radiator section 91 disposed at the first surface 61 of the substrate 60, and a linear second radiator section 92 disposed at the second surface 62 of the substrate 60.

The first radiator section 91 extends along another edge 64 of the substrate 60 and is spaced apart and parallel to the second linear segment 83 of the radiator 800 of the loop antenna 80. A second conductive via 93 extends through the first and second surfaces 61, 62 of the substrate 60 and is proximate to the one end of the edge 63 of the substrate 60.

The second radiator section 92 extends along the edge 63 of the substrate 60 and is connected electrically to the first conductive via 88 and the second conductive via 93. The second radiator section 92 is connected to the feed point 86 on the first surface 61 of the substrate 60 via the first conductive via 88 and the extending segment 85, and to the first radiator section 91 via the second conductive via 93. Moreover, the first radiator section 91 and the second linear segment 83 of the radiator 800 of the loop antenna 80 cooperate to form the second slot 502.

Compared to the first and second embodiments, the present embodiment is capable of further reducing the size of a dual-band antenna by disposing the ground plane 70, the loop antenna 80, and the monopole antenna 90 on the substrate 60; and by disposing radiator sections 91, 92 of the monopole antenna 90 on the opposite surfaces 61, 62 of the substrate 60 and connecting the radiator sections 91, 92 of the monopole antenna 90 to each other and to the loop antenna 80 using conductive vias 88, 93.

In sum, these embodiments of this invention combine a loop antenna capable of resonating at a high frequency band and a monopole antenna capable of resonating at a low frequency band to produce the effect of a dual-band antenna. Furthermore, through the mirror effect of the ground plane, the lengths of the loop antenna and the monopole antenna can be shortened to a quarter of a wavelength at the resonant frequency, or even shorter, thus achieving miniaturization of the dual-band antenna.

While the present invention has been described in connection with what are considered the most practical and preferred embodiments, it is understood that present invention is not limited to the disclosed embodiments but is intended to cover various arrangements included within the spirit and scope of the broadest interpretation so as to encompass all such modifications and equivalent arrangements.

What is claimed is:

1. A dual-band antenna comprising:

a ground plane;

a loop antenna connected to said ground plane, said loop antenna having a radiator that forms a loop, said radiator having a first end and a second end adjacent to said first end, and being capable of resonating at a first frequency band, said loop antenna being a quarter-wavelength rectangular loop antenna;

a monopole antenna having one end connected to said first end of said radiator of said loop antenna, and being capable of resonating at a second frequency band;

a feed point disposed at a connection between said first end of said radiator of said loop antenna and said one end of said monopole antenna;

a ground point disposed at said radiator of said loop antenna proximate to said second end of said radiator; and a substrate having a first surface, a second surface opposite to said first surface, and first and second conductive vias extending through said first and second surfaces and spaced apart from each other, said ground plane and said loop antenna being disposed at said first surface of said substrate, said monopole antenna including a first radiator section and a second radiator section, said first radiator section being disposed at said first surface of said substrate, extending outwardly from said second conductive via and being disposed at one side of said loop antenna, said second radiator section being disposed at said second surface of said substrate and extending from said first conductive via to said second conductive via, said first conductive via being connected electrically to said first end of said loop antenna.

2. The dual-band antenna as claimed in claim 1, wherein said ground plane and said monopole antenna are disposed at opposite sides of said loop antenna, respectively.

3. The dual-band antenna as claimed in claim 1, wherein said radiator of said loop antenna has a ground-connecting segment connected to said ground plane, said ground-connecting segment having one end serving as said second end of said radiator, said ground point being disposed at said ground-connecting segment.

4. A dual-band antenna comprising:

a ground plane;

a loop antenna connected to said ground plane, said loop antenna having a radiator that forms a loop, said radiator having a first end and a second end and defining a first slot that opens toward said first end, said radiator of said loop antenna including a ground-connecting segment connected to said ground plane, a first linear segment connected to said ground-connecting segment, and a second linear segment connected to said first linear segment, said ground-connecting segment and said first and second linear segments cooperating to form said first slot;

a monopole antenna having one end connected to said first end of said radiator of said loop antenna, said monopole antenna and said loop antenna cooperating to form a second slot that opens in a direction away from said first end of said radiator;

a feed point disposed at a connection between said first end of said radiator of said loop antenna and said one end of said monopole antenna;

a ground point disposed at said loop antenna; and a substrate having a first surface and a second surface opposite to said first surface, said ground plane and said loop antenna being disposed at said first surface of said substrate, said monopole antenna including a linear first radiator section and a linear second radiator section connected electrically to said first radiator section, said first radiator section being disposed at said first surface of said substrate and cooperating with said second linear segment of said radiator of said loop antenna to form said second slot, said second radiator section being disposed at said second surface of said substrate and being connected electrically to said first end of said radiator of said loop antenna.

5. The dual-band antenna as claimed in claim 4, wherein said first and second ends of said radiator of said loop antenna are adjacent to each other.

6. The dual-band antenna as claimed in claim 4, wherein said ground plane and said monopole antenna are disposed at opposite sides of said loop antenna, respectively.

* * * * *